United States Patent [19]

Batavier

[11] Patent Number: 4,490,858

[45] Date of Patent: Jan. 1, 1985

[54] GARMENT WITH A POCKET FOR A PURSE OR WALLET

[76] Inventor: Benjamin Batavier, PH.
Gastelaarsstraat 11, 6981 BH
Doesburg, Netherlands

[21] Appl. No.: 304,444

[22] Filed: Sep. 21, 1981

[30] Foreign Application Priority Data

Sep. 29, 1980 [NL] Netherlands ..... 8005383

[51] Int. Cl.[3] ..... A41D 27/20

[52] U.S. Cl. ..... 2/252

[58] Field of Search ..... 2/252, 254, 247, 249, 2/250, 251; 116/84; 150/47

[56] References Cited

U.S. PATENT DOCUMENTS

| | | | |
|---|---|---|---|
| 1,128,230 | 2/1915 | Cowles | 2/252 |
| 1,767,967 | 6/1930 | Davidoff . | |
| 2,408,688 | 10/1946 | Schonthal et al. . | |
| 2,693,164 | 11/1954 | Bruchlos | 2/252 |
| 2,887,689 | 5/1959 | Conlan | 2/252 |
| 4,067,290 | 1/1978 | Hartley | 150/47 |

FOREIGN PATENT DOCUMENTS

| | | |
|---|---|---|
| 361605 | 12/1921 | Fed. Rep. of Germany . |
| 542168 | 10/1921 | France . |
| 1057737 | 10/1953 | France . |
| 291090 | 6/1965 | Netherlands . |
| 483341 | 10/1937 | United Kingdom . |

*Primary Examiner*—Doris L. Troutman
*Attorney, Agent, or Firm*—Lester Horwitz

[57] ABSTRACT

Garment pockets can be closed by buttons or zip fasteners but because many people neglect to do so, there is a need for garments with pockets which prevent pickpocketing without using the traditional closures. This goal has been achieved by having a point in the vicinity of at least one of the ends of the pocket inlet connected by a coupling part to a resilient element which serves to issue an acoustic, or other signal in case of pickpocketing.

11 Claims, 3 Drawing Figures

GARMENT WITH A POCKET FOR A PURSE OR WALLET

Figure 1:
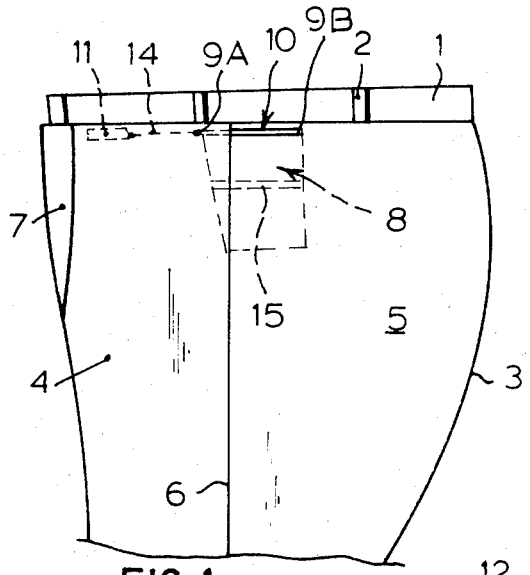

The present invention relates to a garment which is provided with at least one pocket in which a holder for money and/or important personal documents can be carried.

In order to prevent pickpocketing the users of such garments should more frequently use the fastening possibilities that such pockets often have, such as a button fastening or a zip fastener. This is, however, too often neglected and therefore there is an evident need for garments with pockets which prevent pickpocketing without the necessity for the user to open and close the fastening of the respective pocket every time he needs his purse or wallet.

The present invention meets said demand by providing a point in the vicinity of at least one of the ends of the pocket inlet is connected by a coupling part to a resilient element, said point being made flexible or already being flexible because of the type of pocket concerned.

The pocket inlet refers herein to the relatively small surface available for the fingertips of a user or pickpocket at the opening of the pocket before the fingers are inserted therein, and which pocket inlet can be, and has to be enlarged by inserting some fingers or the whole hand.

The distinguishing feature, with respect to the flexibility of the point, is related to the use of the invention in various types of garment pockets.

In a first type of garment pocket, the pocket inlet is provided with a tape reinforcement or the like as a finish. In this type of pocket the invention is preferably used, so that in the usual position the one end of the tape reinforcement of the pocket is behind the fabric of the garment, and when putting the holder in the pocket and when taking it out it can move toward the fabric edge against the influence of a resilient element.

In another type of pocket with vertically extending concertina type folds, the point is already adapted to be displaced because of the nature of the pocket. In this case at least one of the upper buckling points of the folds is connected to a resilient element which causes the buckling point to be drawn as far as possible in the direction of the vertical center line of the pocket in the in use position of said buckling point.

The resilient element may include an alarm which preferably issues an acoustic signal when one end of the tape reinforcement or the buckling point of the concertina type fold is displaced.

In order to make such a pocket also suitable both to put away a purse and a wallet, according to a further variation in the embodiment of the present invention, the pocket is provided with a horizontal separation element, which may be of the type as can be used for closing plastic shoppers.

In order to provide more comfort to the user, it is suggested according to another feature of the invention that the pocket is preferably sewn in trousers just behind a side seam thereof and with the reinforcement tape contacting the trouser band.

The invention can be used in all types of pockets, among which are also sewn-on inner pockets.

Figure 2:
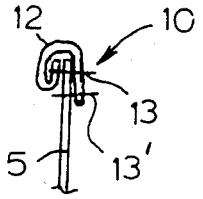
Figure 3:
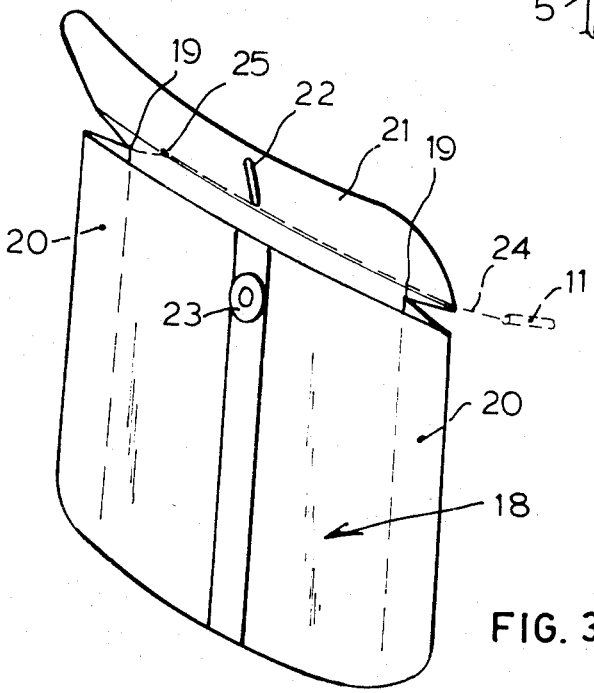

The invention will be further elucidated on the basis of the drawing in which by way of example two embodiments of a garment according to the invention are shown. In the drawing:

FIG. 1 is a side view of an upper part of a trouser,

FIG. 2. is in a larger scale than the true size, a cross-section of a reinforcement tape, and FIG. 3 is, in perspective view, a so-called uniform pocket with concertina folds.

The trouser shown in side view in FIG. 1 consists of a trouser band 1 with loops 2 through which a belt (not shown) can be inserted. The purse and wallet which are intended to be safely taken along in the respective pocket, are not shown so as to provide a clear view in the drawing. The trouser band fronts 4 and rear sections 5, connected by a rear edge 3, are sewn in a known way, while a side seam 6 is formed as well. The trouser usually also has an element which is useful when puting on and taking off the trousers, for instance a fly 7.

As the present invention is most important for those pockets of garments in which money and/or important documents (valuables) are carried. The normal trouser pocket, which is generally present in the front 4, for instance for a handkerchief, is in FIG. 1. In fact here a so-called rear pocket 8 is of more concern, which generally is closer to the rear and the under side than as illustrated in FIG. 1. Such conventional placement is in fact not logical as that is the very place which causes inconvenience, when someone sits down, if it contains a purse. When locating the rear pocket 8 under the band 1, to be higher than usual, one is prevented from sitting on the contents of the pocket. In addition larger things than for instance the purse, such as a wallet, can be carried along, as they need not protrude beyond the pocket edge, and one will not sit on it. Separation element 15 may be provided.

Placing the pocket nearer to the side seam 6 has the advantage that the contents of the pocket fit better in the hollow of the bottom flank and thereby the contents of the pocket are exhibited less to the outside and the way in which the trousers fits is disturbed less when using the pocket.

The mere fact however that the rear pocket 8 is displaced to just behind the side seam 6 and adjacent to the trouser band 1 is not the most important feature of said embodiment of the invention.

The most important feature of FIG. 1 is that when the trousers are used the one end 9A of the reinforcement tape 10 (to be further elucidated on the basis of FIG. 2) is behind the fabric which can be seen from the outside. In the illustrated example end 9A is behind the fabric of the front 4, end 9A is adapted to move against the influence of a resilient element 11, in the direction of the fabric (edge to the right in the drawing) as soon as at least two fingers are inserted into the pocket inlet of the pocket.

In the rear pocket 8 the point 9B which is closest to the rear seam 3, is fixed. Considered from this point the upper side of the inner side of the pocket is sewn onto the trouser band 1 up to approximately 3 cm, calculated from the other movable end 9A of the pocket upper edge, located at the side of the side seam 6. The flexibility is necessary so as to enlarge the pocket inlet when removing the pocket's contents. If a normal trouser pocket is present as well, the looking-in portion of this pocket is drawn rearwardly with said action. The looking-in portion is flexible because it is adapted to slide on a rail or for instance it may slide so that it is guided on half a zip fastener. The most extreme corner of the trouser pocket at the upper side and closest to the fly may also be unattached.

At said unattached pocket point the connection with the resilient element may be provided, which is activated by the pull-out movement made by the user of the pocket.

A direct connection between the reinforcement tape of the rear pocket and the resilient element 11, including the alarm is also possible.

FIG. 2 shows in a somewhat exagerated scale a cross-section of a reinforcement tape 10. It is composed of a double folded piece of fabric 12 which is secured to, in this case, the rear portion 5 of the trousers by means of stitchings 13 and 13'. A somewhat less nicely finished edge is obtained by simply folding the fabric of the portion 5 and sewing it.

The resilient element 11 may include an alarm, issuing a signal, either acoustic or for instance a knock against the body, as soon as the point 9A moves to the right. There seem to exist so-called spring rules which make a ticking sound when being extended, whereas a little pin which has to be pushed to coil the measuring tape up again, performs a minor up- and downgoing movement then. Something similar, but in miniature then, can be used as resilient element 11, but it goes without saying that an electronic safeguard can be used, giving a loud or silent signal.

Point 9A is connected to the element 11 by means of a coupling portion 14 which can be made of any non-flexible material and needs a minimum length which is equal to the maximal distance through which the point 9A is allowed to be displaced. In order not to let the element 11 exert any force when the coupling portion 14 is in the normal position, a stop (not shown) may be provided on the coupling portion.

If the resilient element 11 cannot stand washing of the garment, it will have to be releasable from the coupling portion 14, which is preferably included in a tubular piece of fabric at the interior of the front 6, so that at the point 9A a small, button-hole like hole, has to be made.

In FIG. 3 a second embodiment of the invention, being a so-called uniform pocket, is shown. This embodiment consists of a pocket 18 with points 19, located at the ends of the vertical fold lines between concertina type folds 20. Such a uniform pocket is often provided with a flap 21 with button hole 22, which is adapted to cooperate with a button 23, sewn on the pocket. At least one point 19 is connected by means of a coupling portion 24 to a similar type of resilient element 11 as in FIG. 1. The coupling portion extends from the point 19 through a hole 25 to the rear side of the fabric and then through a tubular piece of fabric to the element 11. This element 11 should be located at a fixed draw point, such as an arm hole.

As will be understood from the above the invention can be used in all types of garments and all types of pockets, provided thereon or therein; particularly also the fashionable sewn-on inner pockets.

In the first instance a safeguard of the rear pocket of the trousers is intended.

The safeguard may, however, also be used in an inner pocket of a jacket or other upper garment, for which the arm hole may serve as draw point.

I claim:

1. A garment comprising:

a pocket for carrying valuables, the pocket having an opening and a flexible edge extending along the opening, a portion of said edge being movable with respect to said garment;

a resilient element having a first portion anchored to the garment, and a second portion movable with respect to said garment; and a coupling member having a first part connected to said second portion of said resilient element and a second part connected to a point along said portion of said edge which is movable with respect to said garment.

2. A garment according to claim 1 in which a part of the pocket including the portion of said edge which is movable with respect to the garment is located behind a fabric of the garment, so that said point is movable against influence of the resilient element, toward an edge of said fabric.

3. A garment according to claim 1, in which the edge of the pocket comprises a reinforcement tape covering the edge, one end of the reinforcement tape being behind a fabric of the garment, said end being movable toward an edge of said fabric against influence of the resilient element.

4. The garment according to claim 3 configured as trousers, having a trouser band, in which the reinforcement tape is disposed along an edge of the trouser band.

5. A garment according to claim 1, in which the pocket includes vertically extending concertina-type folds terminating a buckling points along the edge, at least one of the buckling points being acted upon by said resilient element so that the buckling point is urged in the direction of a vertical center line of the pocket.

6. A garment according to claim 1, configured as trousers in which the first portion of the resilient element is secured to a band of the trousers.

7. A garment according to claim 1 in which the resilient element comprises an alarm which is activated when the point is displaced against influence of the resilient element.

8. A garment according to claim 1 in which a stop is disposed on the coupling member so that tensile pull of the resilient element can be adjusted.

9. A garment according to claim 1 in which the pocket is provided with a horizontal separation element.

10. A garment according to claim 1, configured as trousers in which the pocket is located just behind a side seam thereof.

11. A garment according to claim 1 in which the pocket is a sewn-on inner pocket.

* * * * *